United States Patent [19]

Lanier

[11] 4,133,487

[45] Jan. 9, 1979

[54] METHOD AND APPARATUS FOR COMMINUTING SOLID PARTICLES IN A FLUID STREAM

[75] Inventor: Juan E. Lanier, Dallas, Tex.

[73] Assignee: Ferguson Industries, Inc., Dallas, Tex.

[21] Appl. No.: 811,946

[22] Filed: Jun. 30, 1977

[51] Int. Cl.[2] ..... B02C 23/08

[52] U.S. Cl. ..... 241/5; 241/24; 241/40; 241/81; 241/275

[58] Field of Search ..... 241/5, 20, 21, 24, 40, 241/81, 275

[56] References Cited

U.S. PATENT DOCUMENTS

| | | | |
|---|---|---|---|
| 994,596 | 6/1911 | Marks | 241/275 |
| 1,363,572 | 12/1920 | Dalzell | 241/275 |
| 1,689,932 | 10/1928 | Randecker | 241/81 |
| 2,148,448 | 2/1939 | Edwards | 241/275 |
| 2,468,321 | 4/1949 | Bland | 241/81 |
| 2,487,088 | 11/1949 | Andrews | 241/81 |
| 2,644,740 | 7/1953 | Dodds et al. | 241/275 |
| 3,074,658 | 1/1963 | Brooks | 241/275 |
| 3,860,184 | 1/1975 | Acton | 241/275 |

*Primary Examiner*—Granville Y. Custer, Jr.
*Attorney, Agent, or Firm*—Jack A. Kanz

[57] ABSTRACT

Disclosed is apparatus for separating and comminuting solid particles suspended in a fluid stream. Pumpable slurries containing solid bodies suspended in a liquid are separated into two streams with the larger bodies concentrated in one stream. The stream containing the larger bodies is passed through a mill which accelerates the stream and directs the accelerated stream against a stationery wall. The high speed bodies are fractured by impact with the wall and returned to a mixing vat to be mixed with the remainder of the slurry.

11 Claims, 1 Drawing Figure

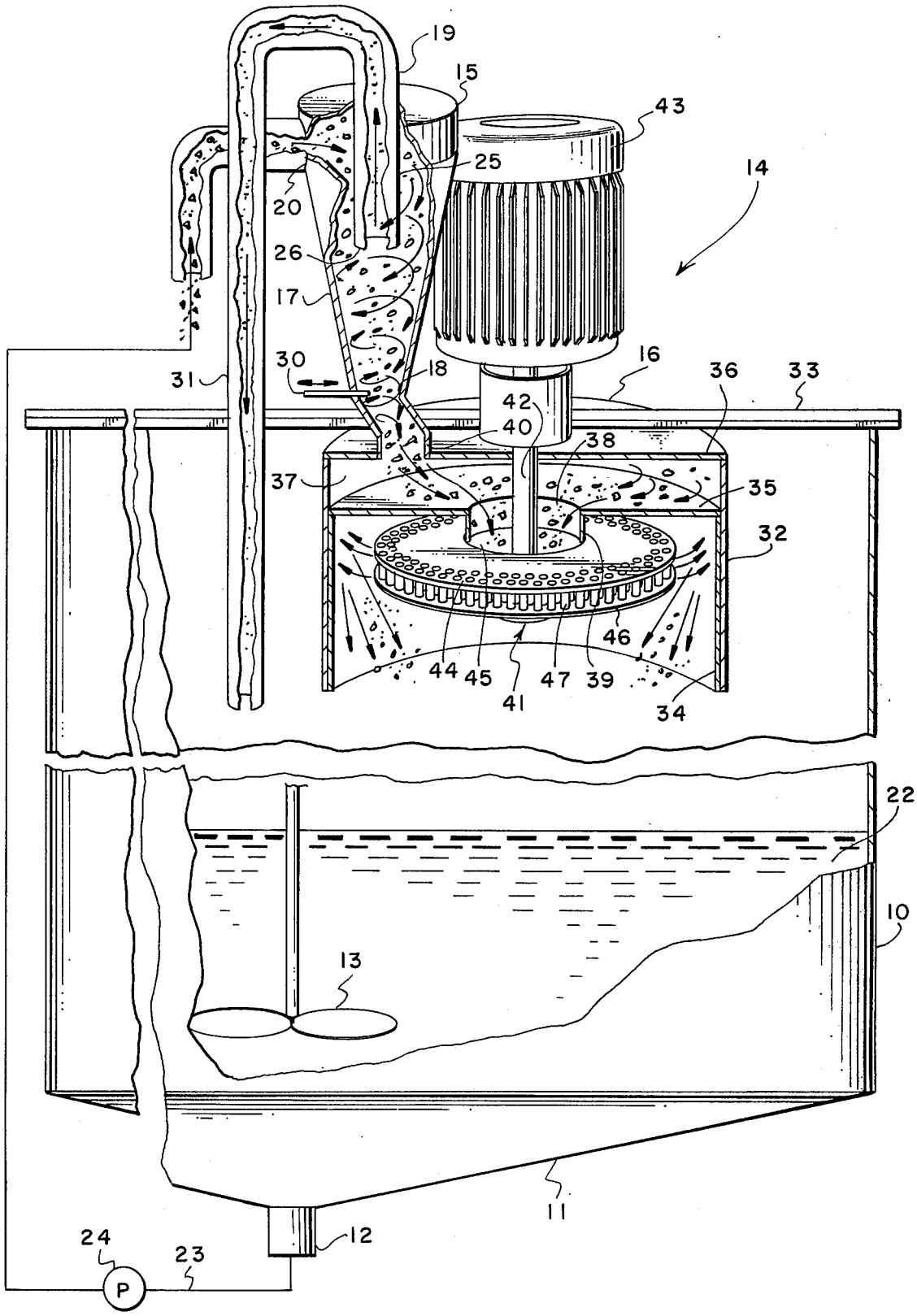
19
15
43
25
14
20
26
17
30
18
16
36
33
31
42
40
38
37
35
32
46
44
45
47
39
41
34
22
10
13
11
12
24
23
P

METHOD AND APPARATUS FOR COMMINUTING SOLID PARTICLES IN A FLUID STREAM

This invention relates to methods and apparatus for fracturing and comminuting solid particles in a fluid stream. More particularly, it relates to apparatus and methods for segregating larger particles from smaller particles carried in a fluid and comminuting the larger particles by accelerating the larger particles and impacting them along with the fluid in which they are suspended against a fixed wall, thereby fracturing the larger particles into smaller particles.

There are many agricultural, industrial and commercial materials which are, in the course of manufacture, distribution or use, dissolved or particulated and suspended in a liquid medium such as water. For example, many agricultural materials such as fertilizers, herbicides, pesticides and the like are manufactured and shipped in a dry, solid or particulated form. The reasons for shipment and storage of such goods in dry form are many. Dry goods are usually more stable and occupy less space than liquids. Thus it is preferrable that such goods be stored in dry form. Furthermore, if water can be readily extracted from the goods prior to shipment, vast savings in shipping costs can be realized. Accordingly, most commercially prepared agricultural fertilizers, herbicides, pesticides and the like are shipped from the manufacturer to the distributor in the dry state and stored in the dry state. However, most such materials are preferrably applied by the end user in the form of a liquid. Therefore, it becomes necessary in the distribution process to dissolve or suspend the dry material in a liquid carrier, usually water. The solution or suspension may then be applied by spraying or the like by the end user. Furthermore, the distributor may desire to mix several products such as a pesticide, herbicide, or the like with a fertilizer or various combinations of fertilizers to produce a liquid mixture or solution designed for a particular application. For such purposes large mixing vats are conventionally employed.

Commercially available mixing vats usually comprise a large tank with a drain opening at the bottom and agitation means suspended therein for agitating the mixture or solution. The required amounts of liquid, usually water, and the dry solid materials to be suspended or dissolved therein are admitted to the mixing vat and the composition agitated until the desired suspension or solution is achieved.

Unfortunately, many materials are not readily dissolved. Furthermore, those materials which are not dissolved but are merely suspended in the liquid medium frequently have formed large particles during the manufacture or shipment thereof. The larger particles must be particulated into fine particles in order that they may be suspended or dissolved in the solution. In some cases, agitation of the mixture is sufficient to break up the larger particles. In other cases, the larger particles are resistant to fracture by mere agitation, therefore other means must be used for fracturing and particulating the larger bodies. Furthermore, in mixing operations where chemical reactions occur between the solid and liquid, it is necessary to particulate the solid to promote faster reaction. Likewise, dissolution of a solid in a liquid is enhanced by reducing the particle size of the solid bodies, thereby increasing surface area and increasing the rate of dissolution or reaction.

In the handling of many fluid compositions, it is customary to form a composition of liquid and solid materials which act as a fluid and thus may be handled by pumps and conduits. Such fluid compositions may include a liquid in which other materials are dissolved or suspended as well as finely particulated solid materials. In addition, the fluid may contain relatively large solid bodies which are too large for collodial suspension in the liquid but which may be pumped in a fluid stream. Such compositions are ordinarily referred to as slurries.

The most common method for fracturing larger particles in a slurry is the use of a fluid milling operation wherein the entire fluid containing all the suspended and/or dissolved smaller particles and the larger particles is pumped through a fluid mill and the entire slurry subjected to the milling operation. Unfortunately, since only a small portion of the slurry (the large particles carried therein) need be subjected to such milling, pumping the entire slurry through the milling device is both time-consuming and wasteful of energy. It would therefore be extremely advantageous to the mixer if the larger particles could be substantially separated from the fine particles and only the larger particles subjected to the milling operation. Furthermore, most fluid milling devices are expensive and cumbersome, thus substantially increasing the cost involved in preparing liquid compositions to customers' requirements.

In accordance with the present invention, apparatus and methods are provided whereby a slurry may be withdrawn from the mixing vat and the larger particles separated from the smaller particles. The fluid containing the smaller particles is returned directly to the mixing vat and the fluid containing the larger particles is directed through a milling apparatus. The milling apparatus is an extremely simple device comprising a pair of horizontally suspended plates rotated at high speeds and surrounded by a rigid shield. The larger particles are conducted to the center of the rotating discs and allowed to pass therebetween. The rotating discs accelerate the fluid containing the larger particles by centrifugal force and eject th particles and fluid at high speed. The high speed particles are impacted directly against the rigid shield and are thereby fractured and particulated. The particulated particles are returned to the mixing vat to be mixed with the remainder of the mixture or solution.

In the preferred embodiment, the milling apparatus is supported directly above the mixing vat so that the particulated material may be returned directly to the mixture. Accordingly, the slurry is continuously drawn from the bottom of the vat and separated and the larger particles comminuted until the required degree of particulation is achieved in the entire liquid body. Since the larger particles are separated from the smaller particles only the larger particles need be subjected to the milling operation, resulting in a vast saving in time and energy requirements for the milling apparatus. Furthermore, since the mixture is returned directly to the vat, the entire vat contents can be continuously agitated and recycled as desired until the required average particle size is obtained. Other features and advantages of the invention will become more readily understood when taken in connection with the appended claims and attached drawing in which the sole FIGURE is a partially diagramatic and partially pictorial and sectional view of apparatus for separating and particulating solid bodies suspended in a fluid in accordance with the invention.

Referring now to the drawing, there is illustrated a conventional mixing vat 10 such as that ordinarily employed in the agricultural industry for forming a slurry of fertilizer suspended in water. While it will be readily recognized that the invention is not limited to use in connection with forming fertilizer slurries, the apparatus will be discussed herein in connection with forming a liquid suspension of fertilizer for illustrative purposes.

Agricultural fertilizer such as mono-ammonium phosphate or di-ammonium phosphate are ordinarily shipped from the manufacturer to the distributor in dry bulk form. The end user, however, prefers to apply the fertilizer in sprayable liquid form. Accordingly, the distributor ordinarily employs a vat mixing process to mix the dry materials with water to form a solution and/or suspension of the fertilizer in water. Furthermore, herbicides, pesticides and the like may be added to the slurry to form the composition desired by the ultimate customer.

In forming liquid slurries of fertilizers, a mixing vat such as that illustrated is commonly employed. A desired amount of water is placed in the vat and the dry materials added to the vat and the mixture agitated to form a liquid slurry. Since fertilizers usually contain materials which are not readily dissolved in water, other materials such as attapulgite clay or the like are sometimes added to the slurry to maintain the insoluble materials in suspension. The desired end result is a mixture containing fine solid particles in suspension which remains liquid for indefinite periods of time and which can be easily pumped and distributed through sprayers.

The mixing apparatus illustrated comprises a cylindrical vat 10 with a funnel-shaped bottom 11 terminating in a centrally located opening 12. An agitator 13 is suspended within the vat and driven by conventional drive means (not shown). The top of the vat is usually open and the materials to be mixed are simply poured or pumped into the vat and the mixture agitated until the desired composition is achieved.

Unfortunately, the dry materials to be mixed may contain large lumps which are not easily dissolved and/or suspended in the slurry. Therefore it is necessary to comminute the large bodies to aid in dissolution and suspension thereof so that a sprayable slurry can be formed.

Apparatus for comminuting and separating the larger particles in accordance with the invention is generally indicated at 14. The separating and comminuting apparatus 14 includes a separator 15 which separates larger solid bodies from the smaller bodies in the fluid and a comminuting apparatus 16 which breaks the larger particles into smaller particles.

The separator apparatus 15 comprises an enclosed substantially funnel-shaped housing 17 having an outlet 18 at the bottom thereof, an outlet 19 at the top thereof and inlet 20 at the side thereof near the top wall. Fluid 22 contained in vat 10 is withdrawn from the vat outlet 12. The fluid is pumped from outlet 12 through line 23 and pump 24 (illustrated schematically) and into inlet 20 in the separator. Inlet 20 is aligned tangentially to the wall of the separator housing 17 near the top wall thereof. Accordingly, the liquid pumped into the inlet 20 is forced into separator 15 tangentially to the side walls.

Outlet 19 is placed substantially centrally in the top wall of the separator and comprises a tube 25 which extends centrally into the separator housing 17 and has an opening 26 preferrably below the inlet 20.

The slurry pumped into inlet 20 comprises materials dissolved in the liquid, small solid bodies suspended in the liquid and larger bodies which are pumped with the slurry but would not be suspended in the liquid at rest. Since the liquid is pumped into the separator housing 17 under pressure and tangential to the side walls of the separator 15, the liquid follows a circular path around the inner walls 17 of the separator and gravitates toward the bottom opening 18. Since the larger particles are denser than the remainder of the fluid, the larger particles follow the path indicated by the arrows and gravitate toward the bottom of the separator. The bottom outlet 18 of the separator is controlled by a gate 30 which controls the cross-sectional area of the outlet 18. Accordingly, outlet 18 may be controlled to vary the flow rate through gate 18 and, likewise, the rate of flow through outlet 19. The smaller bodies suspended in the fluid do not gravitate toward the bottom outlet 18 and are carried out through a top outlet 19 as indicated by the arrows. It will thus be apparent that separator 15 may be used to separate the fluid into two streams; one containing the larger bodies and the second stream containing the smaller bodies. The amount of separation, of course, is dependent upon the relative rate of flow through outlets 18 and 19 which may be varied as desired by gate 30. The fluid exiting the separator through outlet 19 is returned directly to the vat 10 by means of return line 31. The fluid containing the larger particles is directed into the comminuting apparatus 16.

Bottom opening 18 need not be of variable size. Where the pressure and flow rates of the liquid may be varied as desired, where areas of the other openings may be varied or where the conditions under which the system are known or may be calculated in advance, the required size of the orifice in bottom opening 18 may be determined in advance and a fixed orifice of the desired area used.

The comminuting apparatus comprises a cylindrical housing 32 open at the bottom end and closed at the top end by top wall 36. The housing 32 is supported over the open vat 10 by suitable support means such as beams 33 or the like. In the embodiment illustrated, the cylindrical housing 32 contains an inner housing 34 which substantially conforms to the internal dimensions of housing 32. However, the top wall 35 of the inner housing 34 is spaced from the top wall 36 of the outer housing 32, thus defining a plenum chamber 37 between the top of the outer cylinder and the top of the inner cylinder. The top 35 of inner cylinder 34 has a centrally located aperture 38 with a downwardly depending flange 39. The top wall 36 of the outer cylinder has an inlet 40 which communicates with the bottom outlet 18 of the separator. Thus the fluid stream containing the larger particles exiting from the bottom outlet 18 of the separator is fed into plenum chamber 37 through inlet 40 and exits the plenum chamber 37 through aperture 38.

A rotatable accelerator 41 is suspended within the inner cylinder 34 by shaft 42 which passes transversely centrally through aperture 38. Shaft 42 is driven by suitable power means such as electric motor 43.

The accelerator 41 comprises a pair of horizontally disposed rotatable parallel discs having a common central axis. The top disc 44 has a centrally located aperture 45 and is secured to and spaced from the bottom disc 46 by a plurality of vertically extending spacers 47. Spacers 47 are arranged near the periphery of and between the discs 44 and 46 to rigidly affix the top disc 44 to the bottom disc 46 in a permanently fixed spaced relationship. Shaft 42 passes through the central aperture 45 of the top disc and is secured to the center of the bottom disc 46. Thus, by rotation of shaft 42 the discs rotate about a common central axis in a substantially horizontal plane. The accelerator 41 is positioned so that the depending flange 39 extends to or within the centrally located aperture 45 in the top disc 44. Accordingly, fluid passing through bottom outlet 18 in separator 15 into the plenum chamber 37 exits the plenum chamber 37 through the centrally located aperture 38 and is thus directed between the top disc 44 and bottom disc 46. Upon rotation of the discs, the fluid entering through the aperture 38 is moved horizontally by centrifugal force and ejected horizontally between the discs. The side walls of the inner cylinder 34 form a rigid substantially vertically extending wall surrounding the horizontal edges of the discs. Therefore, liquid and solids ejected from between the discs are directed against the side walls of the inner cylinder 34.

The vertically extending spacers 47 serve to maintain a fixed relationship between the top disc 44 and the bottom disc 46. Spacers 47 also serve as paddles or beaters to accelerate the fluid and solid bodies passing therebetween to or near the angular velocity of the periphery of the rotating discs.

In the preferred embodiment, the spacers 47 are circular in cross-section and positioned in a pair of concentric circles near the periphery of the discs. To insure that solid bodies passing between the discs contact one or more of the vertically extending spacers yet permit adequate spacing between the spacers so that large bodies may pass therebetween, the vertically extending spacers 47 are preferrably arranged in concentric circles wherein the spacers in the inner circle are radially displaced inwardly from those in the outer circle and displaced circumferentially so that each spacer in the inner circle is positioned between two vertically extending members in the adjacent outer circle. Alternatively, spacers 47 may be replaced by vanes or solid bars extending radially between the discs and securing the discs together. Such radially extending bars act both to secure the discs together and to accelerate the fluid passing therebetween. Where large and abrasive solid bodies are encountered, the use of radial bars may be preferrable to prevent clogging and to resist excessive wear. Furthermore, the bars may extend radially outwardly from the discs, thus increasing the velocity of the exiting solid bodies and beating against some of the larger particles which may rebound from the wall 34. It will thus be observed that as the fluid moves horizontally between the adjacent rotating discs, the solid bodies contained therein are contacted by the vertically extending spacers and accelerated to the angular velocity of the periphery of the rotating discs. The solid bodies and the fluid are thus ejected substantially tangentially from the periphery of the rotating discs and directed against the rigid side wall of the inner cylinder 34 at velocities approximating the angular velocity of the edge of the accelerator 41. The solid bodies are substantially fractured and particulated by impact with the rigid wall and fall directly into the vat 10. The fluid sprayed against the wall 34 by the accelerator aids in comminuting the solid bodies and cleaning the wall 34.

The effectiveness of the apparatus in comminuting solid bodies depends, of course, on factors such as distance between the edge of the accelerator and the wall 34, the diameter of the accelerator, the rotational velocity of the accelerator, and the cohesiveness of the solid bodies. For comminuting phosphatic fertilizers in a slurry, effective milling is accomplished using discs approximately 22 inches in diameter rotated at about 2300 rpm. Under those conditions the fluid and solid bodies contained therein are impacted against the wall 34 at speeds up to about 150 miles per hour. The slurry may be conveniently recycled through the separator and accelerator as many times as required to reduce the particle size to the desired dimensions.

It will be noted that by separating the slurry into two component streams, one containing the relatively larger bodies and one containing the relatively smaller bodies, the average particle size of solid bodies in a pumpable fluid can be rapidly reduced by only comminuting the larger bodies. Since the entire slurry need not be run through the milling apparatus, great savings in time are realized. Furthermore, since the denser bodies are concentrated in a relatively small stream of liquid, the horsepower requirements of the drive motor are effectively reduced, resulting in reduced energy requirements.

While the invention has been described with particular reference to forming a slurry of agricultural fertilizer, it will be readily apparent that the principles thereof may be applied to various other comminuting, mixing, reaction and dissolution processes. It is to be understood, therefore, that although the invention has been described with particular reference to a specific embodiment thereof, the form of the invention shown and described in detail is to be taken as the preferred embodiment of same, and that various changes and modifications may be resorted to without departing from the spirit and scope of the invention as defined by the appended claims.

What is claimed:

1. The method of comminuting solid bodies suspended in a liquid comprising the steps of:

(a) substantially separating said liquid into a stream containing larger solid bodies and a stream containing smaller solid bodies;

(b) accelerating said stream containing the larger bodies to a velocity of approximately 150 mph; and (c) directing said accelerated stream against a rigid substantially immobile wall, thereby to fracture and comminute said larger solid bodies.

2. The method set forth in claim 1 wherein said liquid is separated by injecting said liquid into a substantially funnel-shaped enclosed housing having an outlet at the top thereof and an outlet at the bottom thereof wherein said liquid is injected through an inlet near the top of said housing tangentially to the side wall of said housing, thereby causing the larger bodies to gravitate toward the bottom of said housing and the smaller bodies to be carried out through the top outlet.

3. The method set forth in claim 1 including the step controlling the cross-sectional area of the outlet at the bottom of said funnel-shaped enclosure to control relative rates of flow through the top and bottom outlets.

4. Apparatus for comminuting solids suspended in a liquid comprising:

(a) tank means for containing a mixture of solid bodies and a liquid;

(b) separation means for separating larger and smaller solid bodies suspended in said liquid;

(c) pump and conduit means for withdrawing said mixture from said tank means and transferring said mixture to said separator means;

(d) first and second substantially horizontally disposed rotatable coaxial parallel discs suspended above said tank means;

(e) spacer means disposed between said discs maintaining a fixed relationship therebetween;

(f) means for rotating said discs about a common central axis;

(g) substantially vertically extending rigid walls means surrounding the horizontal edges of said discs; and (h) means for conducting the liquid stream containing said larger bodies from said separator means and inserting said liquid stream between said discs.

5. Apparatus as defined in claim 4 wherein said spacer means comprises a plurality of vertically extending members disposed in a plurality of concentric circles near the outer periphery of said discs with the vertically extending members in one concentric circle positioned radially displaced and circumferentially between the vertically extending members in an adjacent circle.

6. Apparatus as defined in claim 4 wherein said first disc is supported above said second disc by said spacer means and has a centrally located aperture therein, and said second disc is supported by a drive shaft secured to the center of said second disc and extending through said centrally located aperture in said first disc.

7. Apparatus as defined in claim 4 wherein the diameter of said discs is approximately 22 inches.

8. Apparatus as defined in claim 4 wherein said spacer means are elongated bars extending radially between said discs and radialy beyond the outer edges of said discs.

9. Apparatus as defined in claim 4 wherein said means for separating said bodies comprises:

(a) an enclosed substantially funnel-shaped housing having an outlet at the bottom thereof, an outlet at the top thereof and inlet in the side thereof near the top wall of said enclosed housing and arranged to inject liquid into said housing substantially horizontally and tangentially to the side wall of said housing; and (b) means for supplying liquid carrying solid bodies therein to said inlet in sufficient volume to cause liquid to flow through said housing and exit simultaneously through both said outlets.

10. Apparatus as defined in claim 9 wherein said outlet in the top of said housing comprises a tube passing substantially vertically through the top wall of said housing and extending centrally into said housing, said tube having an opening therein below said inlet.

11. Apparatus as defined in claim 9 including means for variably controlling the cross-sectional area of the outlet at the bottom of said enclosure.

* * * * *

UNITED STATES PATENT OFFICE

CERTIFICATE OF CORRECTION

Patent No. 4,133,487 Dated January 15, 1979

Inventor(s) Juan E. Lanier

It is certified that error appears in the above-identified patent and that said Letters Patent are hereby corrected as shown below:

In Column 2, line 41, "th" should read ---the---

In Column 6, line 56 should read ---3. The method set forth in claim 1 including the step of---

In Column 7, line 9, "walls" should read ---wall---

In Column 8, line 5, "radialy" should read ---radially---

On the title page, in the paragraph entitled "ABSTRACT", line 8, "stationery" should read ---stationary---

In Column 2, line 65, "diagramatic" should read ---diagrammatic---

Signed and Sealed this

*Third* Day of *April 1979*

[SEAL]

*Attest:*

RUTH C. MASON
*Attesting Officer*

DONALD W. BANNER
*Commissioner of Patents and Trademarks*